US009225072B2

(12) United States Patent
Takahashi et al.

(10) Patent No.: US 9,225,072 B2
(45) Date of Patent: Dec. 29, 2015

(54) RADIOWAVE ABSORBER

(71) Applicants: Toshihide Takahashi, Kanagawa (JP); Tomohiro Suetsuna, Kanagawa (JP); Koichi Harada, Tokyo (JP); Seiichi Suenaga, Kanagawa (JP)

(72) Inventors: Toshihide Takahashi, Kanagawa (JP); Tomohiro Suetsuna, Kanagawa (JP); Koichi Harada, Tokyo (JP); Seiichi Suenaga, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 260 days.

(21) Appl. No.: 13/681,713

(22) Filed: Nov. 20, 2012

(65) Prior Publication Data

US 2013/0257639 A1 Oct. 3, 2013

(30) Foreign Application Priority Data

Mar. 30, 2012 (JP) ..... 2012-078743

(51) Int. Cl.
*H01Q 17/00* (2006.01)

(52) U.S. Cl.
CPC ..... *H01Q 17/00* (2013.01); *H01Q 17/004* (2013.01)

(58) Field of Classification Search
CPC ..... H01F 1/33; H01F 1/24; H01Q 17/00; H01Q 17/004
USPC ..... 342/1–4; 343/787
See application file for complete search history.

(56) References Cited

U.S. PATENT DOCUMENTS

| | | | | |
|---|---|---|---|---|
| 3,773,684 | A * | 11/1973 | Marks | 252/583 |
| 5,398,826 | A * | 3/1995 | Takakusaki et al. | 215/400 |
| 7,108,799 | B2 * | 9/2006 | Kobayashi et al. | 252/62.62 |
| 2007/0269681 | A1 * | 11/2007 | Aiga et al. | 428/692.1 |
| 2008/0220231 | A1 * | 9/2008 | Suetsuna et al. | 428/216 |
| 2009/0242826 | A1 * | 10/2009 | Harada et al. | 252/62.55 |
| 2010/0060538 | A1 * | 3/2010 | Suetsuna et al. | 343/787 |
| 2010/0060539 | A1 * | 3/2010 | Suetsuna et al. | 343/787 |
| 2012/0049100 | A1 | 3/2012 | Yonetsu et al. | |

FOREIGN PATENT DOCUMENTS

| | | |
|---|---|---|
| CN | 102385967 A | 3/2012 |
| JP | 2001-358493 | 12/2001 |

(Continued)

OTHER PUBLICATIONS

Office Action issued Jun. 17, 2014 in Japanese Patent Application No. 2012-078743 (with English language translation).

(Continued)

*Primary Examiner* — John B Sotomayor
*Assistant Examiner* — Marcus Windrich
(74) *Attorney, Agent, or Firm* — Oblon, McClelland, Maier & Neustadt, L.L.P.

(57) ABSTRACT

A radiowave absorber of an embodiment includes: core-shell particles each including: a core portion that contains at least one magnetic metal element selected from a first group including Fe, Co, and Ni, and at least one metal element selected from a second group including Mg, Al, Si, Ca, Zr, Ti, Hf, Zn, Mn, rare-earth elements, Ba, and Sr; and a shell layer that coats at least part of the core portion, and includes an oxide layer containing at least one metal element selected from the second group and contained in the core portion; and a binding layer that binds the core-shell particles, and has a higher resistance than the resistance of the core-shell particles. The volume filling rate of the core-shell particles in the radiowave absorber is not lower than 10% and not higher than 55%.

9 Claims, 2 Drawing Sheets

(56) References Cited

FOREIGN PATENT DOCUMENTS

| | | |
|---|---|---|
| JP | 2008-258601 A | 10/2008 |
| JP | 2010-87462 | 4/2010 |

OTHER PUBLICATIONS

Extended European Search Report issued on May 8, 2013 in Application No. 12193203.2.

Cheng-Hsiung Peng, et al., "Microwave absorbing materials using Ag—NiZn ferrite core-shell nanopowders as fillers", Journal of Magnetism and Magnetic Materials, Elsevier Science Publishers,vol. 284, XP004654406, Dec. 1, 2004, pp. 113-119.

Tomohiro Suetsuna, et al., "Fabrication of nanocomposite using self-forming core/shell nanoparticles and its magnetic properties at up to gigahertz bands for high-frequency applications", Journal of Applied Physics, American Institute of Physics, vol. 106, No. 8, XP012127721, Oct. 28, 2009, 5 pages.

Office Action issued Jan. 27, 2015 in Japanese Patent Application No. 2012-078743 (with English language translation).

Chinese Office Action issued Apr. 14, 2015, in corresponding Chinese Patent Application 201210500269.7 (with English-language Translation).

* cited by examiner

RADIOWAVE ABSORBER

CROSS-REFERENCE TO RELATED APPLICATION

This application is based upon and claims the benefit of priority from Japanese Patent Application No. 2012-078743, filed on Mar. 30, 2012, the entire contents of which are incorporated herein by reference.

FIELD

Embodiments described herein relate generally to radiowave absorbers.

BACKGROUND

A radiowave absorber of a magnetic-loss type using a magnetic material normally has absorption characteristics for a wider band than those of radiowave absorbers of a dielectric-loss type or a conduction-loss type. However, magnetic-loss type radiowave absorbers that have excellent characteristics in 8 to 18 GHz band (X-band or Ku-band) have not been realized.

DETAILED DESCRIPTION

A radiowave absorber of an embodiment includes: core-shell particles each including: a core portion that contains at least one magnetic metal element selected from a first group including Fe, Co, and Ni, and at least one metal element selected from a second group including Mg, Al, Si, Ca, Zr, Ti, Hf, Zn, Mn, rare-earth elements, Ba, and Sr; and a shell layer that coats at least part of the core portion, and includes an oxide layer containing at least one metal element selected from the second group and contained in the core portion; and a binding layer that binds the core-shell particles, and has a higher resistance than the resistance of the core-shell particles. The volume filling rate of the core-shell particles in the radiowave absorber is not lower than 10% and not higher than 55%.

The following is a description of an embodiment of the present disclosure, with reference to the accompanying drawings.

A radiowave absorber of the embodiment includes core-shell particles each including: a core portion that contains at least one magnetic metal element selected from a first group including Fe, Co, and Ni, and at least one metal element selected from a second group including Mg, Al, Si, Ca, Zr, Ti, Hf, Zn, Mn, rare-earth elements, Ba, and Sr; and a shell layer that coats at least part of the core portion, and includes an oxide layer containing at least one metal element selected from the second group and contained in the core portion, and carbon-containing material layer. The radiowave absorber further includes a binding layer that binds the core-shell particles, and has a higher resistance than the resistance of the core-shell particles. The volume filling rate of the core-shell particles in the radiowave absorber is not lower than 10% and not higher than 55%.

Having the above structure, the radiowave absorber of this embodiment achieves excellent radiowave absorption characteristics in high-frequency bands, particularly, in 8-18 GHz band (X-band or Ku-band).

Figure 1A:
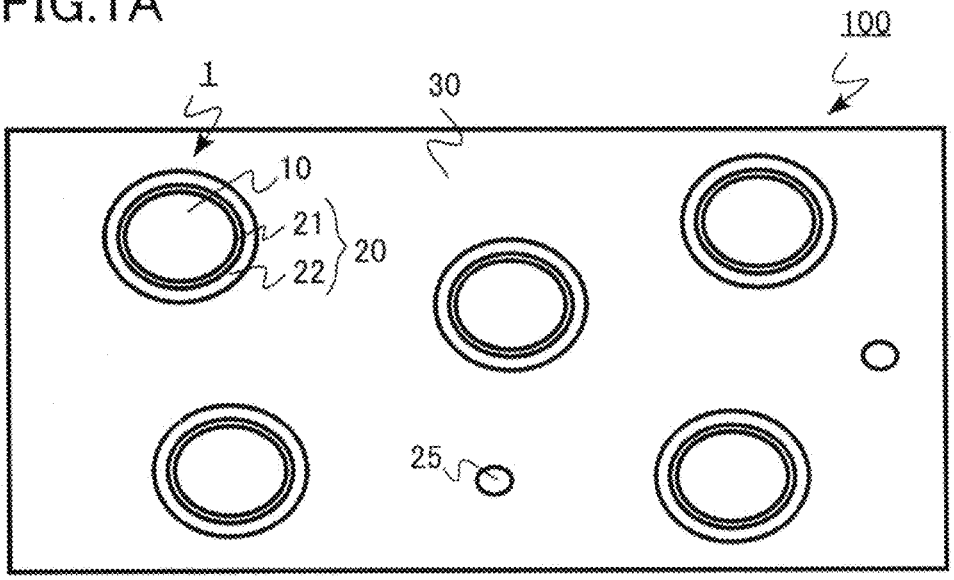
FIGS. 1A and 1B are schematic cross-sectional views of radiowave absorbers according to an embodiment.
Figure 1B:
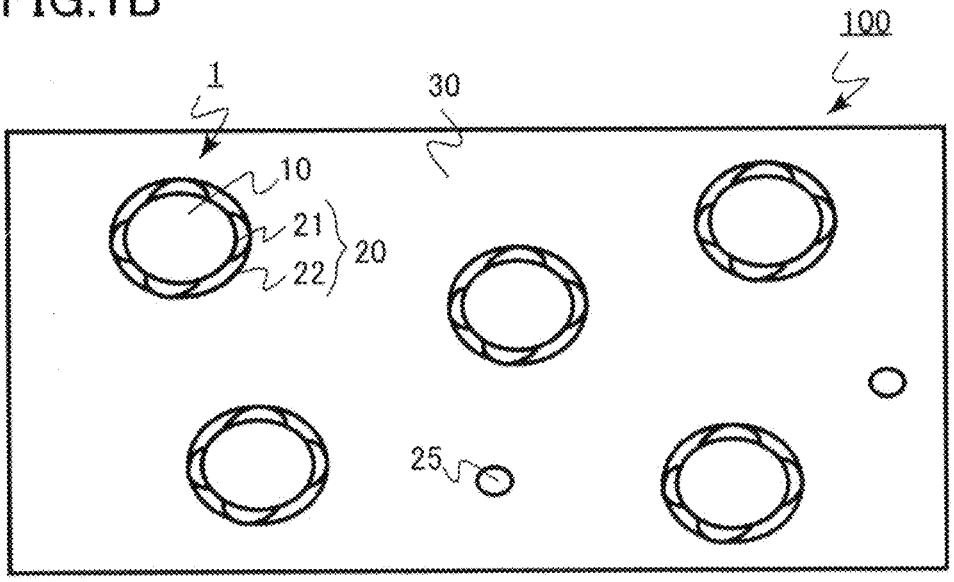

FIGS. 1A and 1B are schematic cross-sectional views of radiowave absorbers according to an embodiment. FIGS. 1A and 1B illustrate radiowave absorbers having different shell layer structures from each other.

Each radiowave absorber 100 includes core-shell particles 1, and a binding layer 30 that binds the core-shell particles 1. The binding layer 30 has a higher resistance than the core-shell particles 1, and is made of a resin, for example.

Each core-shell particle 1 includes a core portion 10, and a shell layer 20 that coats at least part of the core portion 10. The core portion 10 contains at least one magnetic metal element selected from a first group including Fe, Co, and Ni, and at least one metal element selected from a second group including Mg, Al, Si, Ca, Zr, Ti, Hf, Zn, Mn, rare-earth elements, Ba, and Sr.

The shell layer 20 is formed with an oxide layer 21 and a carbon-containing material layer 22. The oxide layer 21 contains at least one metal element that is selected from the second group and is contained in the core portion 10. In the case of FIG. 1A, the oxide layer 21 is provided to cover the core portion 10, and the carbon-containing material layer 22 is provided to cover the oxide layer 21. In the case of FIG. 1B, the shell layer 20 covering the core portion 10 is a mixed layer of the oxide layer 21 and the carbon-containing material layer 22.

The core-shell particles 1 are not limited to the above-described form, and may be in various other forms. In a case where the oxide layers 20 are formed so that the core portions 10 are not in contact with one another, part of the carbon-containing material layers 22 may not be formed, so as to achieve a predetermined ratio.

There are cases where a radiowave absorber 100 contains oxide particles 25 as well as the core-shell particles 1. The oxide particles 25 are formed when the oxide layers 21 are detached from the core-shell particles 1. The oxide particles 25 each contain an element that belongs to the second group and is also contained in the core portions 10 and the oxide layers 21. If the oxide layers 21 are not detached from the core-shell particles 1, the radiowave absorber 100 may not contain the oxide particles 25.

The volume filling rate of the core-shell particles 1 in each radiowave absorber is not lower than 10% and not higher than 55%. More preferably, the volume filling rate is not lower than 15% and not higher than 40%. Where the volume filling rate becomes higher than the above range, metallic characteristics appear, and the reflectance becomes higher. As a result, radiowave absorption characteristics are degraded. Where the volume filling rate becomes lower than the above range, saturation magnetization becomes lower. As a result, radiowave absorption characteristics depending on magnetic characteristics might be degraded. Also, the thickness required for achieving practical radiowave absorption characteristics might become too large.

Figure 2:
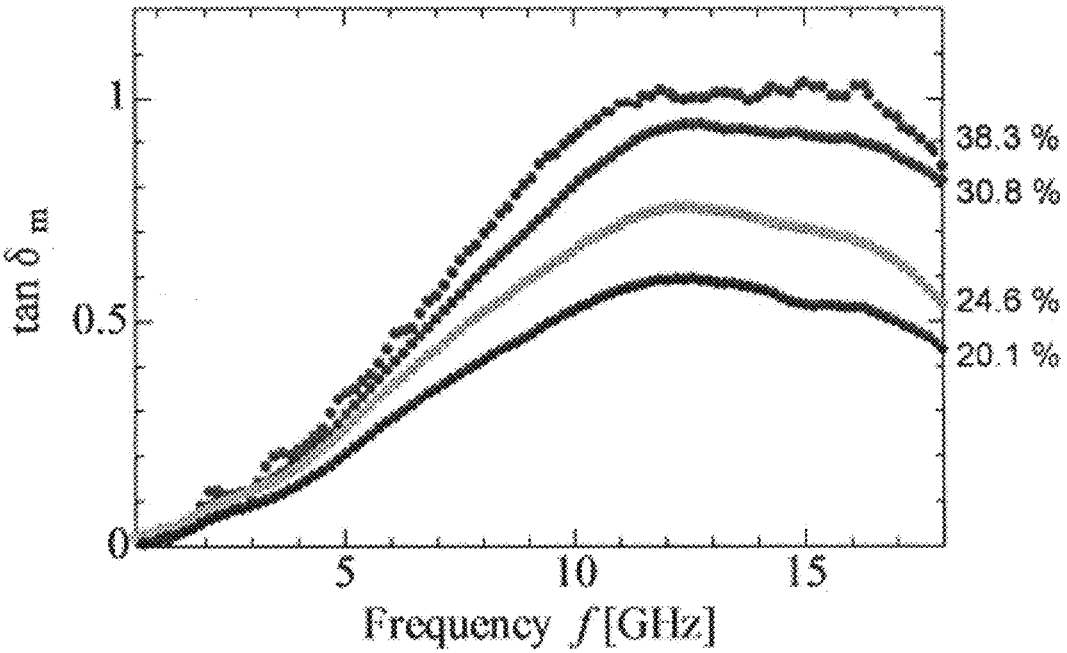
FIG. 2 is a graph showing magnetic loss coefficients (tan δm(μ"/μ')) of radiowave absorbers of the embodiment.

FIG. 2 is a graph showing the electromagnetic characteristics of radiowave absorbers of this embodiment. The abscissa axis indicates frequency, the ordinate axis indicates magnetic loss coefficient tan δm (magnetic permeability imaginary part/magnetic permeability real part), and the numbers (%) indicate measured volume filling rates of the core-shell particles in the radiowave absorbers.

As can be seen from FIG. 2, the radiowave absorbers of this embodiment achieve high radiowave absorption characteristics with high loss in the high-frequency band of 8-18 GHz (the X-band, or the Ku-band). The dependence of tan δm on the composition of the core-shell particles 1 is restricted within a much narrower range than the dependence on the volume filling rate.

The volume filling rate in each radiowave absorber can be calculated by subjecting a TEM (Transmission Electron Microscopy) photograph to image processing.

The electrical resistance of each radiowave absorber is 10 MΩ·cm or higher, preferably 100 MΩ·cm or higher, or more preferably, 1000 MΩ·cm. Within such a range, radiowave reflection is restrained, and high radiowave absorption characteristics with high loss are achieved.

The electrical resistance was calculated by forming Au electrodes of 5 mm in diameter by performing sputtering on the front and back surfaces of a disk-like sample of 15 mm in diameter and 1 mm in thickness, and reading the value of the current generated when a voltage of 10 V was applied between the electrodes. Since the values of the current have time dependence, each measured value is the value that was measured two minutes after the voltage application.

In the following, the structure of each radiowave absorber is described in detail.

(Core-Shell Particles)

The shapes of the core-shell particles are now described. Each of the core-shell particles may have a spherical shape, but preferably have a flat shape or a rod-like shape with a high aspect ratio (10 or higher, for example). The rod-like shape may be a spheroid. Here, the "aspect ratio" indicates the ratio between height and diameter (height/diameter). Where each of the core-shell particles has a spherical shape, the height and the diameter are equal to each other, and accordingly, the aspect ratio is 1. The aspect ratio of a flat particle is "the diameter/the height". The aspect ratio of a rod-like particle is "the length of the rod/the diameter of the bottom surface of the rod". However, the aspect ratio of a spheroid is "the long axis/the short axis".

By increasing the aspect ratio, magnetic anisotropy depending on shapes can be provided, and the high-frequency properties of the magnetic permeability can be improved. Furthermore, the core-shell particles can be readily oriented by a magnetic field when integrated and formed into a desired component, and the high-frequency properties of the magnetic permeability can be further improved. Also, by increasing the aspect ratio, the limit particle size for the core portions to be single-domain structures can be increased to a size larger than 50 nm, for example. Where the core portions each have a spherical shape, the limit particle size for the core portions to be single-domain structures is approximately 50 nm.

Flat core-shell particles with a high aspect ratio can each have a large limit particle size, and the high-frequency properties of the magnetic permeability are not degraded. In general, particles with a larger particle size are easier to be synthesized. Therefore, a high aspect ratio is considered advantageous, from a manufacturing standpoint. Further, when a desired component is made from core-shell particles, the filling rate can be made higher by increasing the aspect ratio. Accordingly, the saturation magnetization of the component per volume and per mass can be increased. As a result, the magnetic permeability can also be made higher.

It should be noted that the mean particle size in a particle size distribution of core-shell particles can be determined as follows. Through TEM observations and SEM (Scanning Electron Microscopy) observations, the particle size of each of the particles is calculated as the mean value of the longest diagonal line and the shortest diagonal line of the particle. The mean particle size of core-shell particles can be determined from the mean value of a large number of particle sizes.

(Core Portion)

The core portions of the above-described metal-containing particles contain at least one magnetic metal element selected from the first group including Fe, Co, and Ni (a first-group metal element), and at least one metal element selected from the second group including Mg, Al, Si, Ca, Zr, Ti, Hf, Zn, Mn, rare-earth elements, Ba, and Sr (a second-group metal element).

As the core portions contain a first-group magnetic metal element, a higher magnetic permeability can be achieved by using the core-shell particles to form a composite component. Meanwhile, an oxide of a second-group metal element has a small standard Gibbs energy of formation, and is readily oxidized. Accordingly, the second-group element existing near the surfaces of the core portions easily forms the oxide layers 21. Also, as the oxide layers 21 contain the second-group element, stable electrical insulation properties can be achieved by using the core-shell particles to form a composite component.

The magnetic metal (the first-group metal element) contained in the core portions may be a single metal element, or may be an alloy. Particularly, an Fe-base alloy, a Co-base alloy, a FeCo-base alloy are preferable, being able to realize high saturation magnetization. Examples of Fe-base alloys include alloys containing Ni, Mn, Cu, or the like as a second component, such as a FeNi alloy, a FeMn alloy, and a FeCu alloy. Examples of Co-base alloys include alloys containing Ni, Mn, Cu, or the like as a second component, such as a CoNi alloy, a CoMn alloy, and a CoCu alloy. Examples of FeCo-base alloys include alloys containing Ni, Mn, Cu, or the like as a second component. Specifically, a FeCoNi alloy, a FeCoMn alloy, or a FeCoCu alloy can be used. Those second components are effective for reducing magnetic loss in a composite component using the core-shell particles and improving the high-frequency magnetic characteristics.

Among the magnetic metals, FeCo-base alloys are particularly preferable. The Co content in the FeCo is preferably 10 atomic % or more but not more than 50 atomic %, to achieve thermal stability, oxidation resistance, and saturation magnetization of 2 tesla or more. More preferably, the Co content in the FeCo is 20 atomic % or more but not more than 40 atomic %, to improve saturation magnetization.

Among the elements belonging to the second group, Al and Si have high solid solubility with Fe, Co, and Ni, which are the main components of the core portions, and contribute to improvement of the thermal stability of the core-shell particles. Therefore, Al and Si are preferable. The use of Al is particularly preferable, because Al increases thermal stability and oxidation resistance. If Al and Si are contained at the same time, aggregation and grain growth of the core-shell particles are restrained, and characteristics such as the high-frequency magnetic permeability, the thermal stability, and the oxidation resistance of the obtained composite component are further improved. Therefore, the simultaneous use of Al and Si is more preferable. Also, those characteristics can be improved by adding another element belonging to the second group to the element belonging to the second group. As an active metal element such as a rare-earth element is selected as the element to be added, aggregation and grain growth of the core-shell particles are restrained, and characteristics such as the high-frequency magnetic permeability, the thermal stability, and the oxidation resistance of the obtained composite component can be further improved.

Therefore, an active metal element is preferable as the element to be added. For example, it is preferable to add a rare-earth element such as Y to an element containing at least one of Al and Si. Alternatively, the same effect as above can be expected where the valence of the element to be added, which is another element belonging to the second group, is made to differ from the valence of the element belonging to the second group. Furthermore, the same effect as above can also be expected where the radius of the atoms of the element to be added, which is another element belonging to the second group, is made larger than the radius of the atoms of the element belonging to the second group.

Carbon atoms or nitrogen atoms may be solid-solved in the core portion material.

The compositions of the first-group and second-group elements contained in the core portions can be analyzed in the following manner, for example. Examples of analysis methods for a nonmagnetic metal such as Al include ICP (Inductively Coupled Plasma) emission spectrometry, TEM-EDS (Energy Dispersive X-ray Spectrometer), XPS (X-ray Photoelectron Spectroscopy), and SIMS (Secondary Ion Mass Spectrometry). By the ICP emission spectrometry, the composition of the core portions is checked by comparing the results of analyses carried out on the magnetic metal particle portions (the core portions) solved in weak acid, the residues of the shell layers solved in alkali or strong acid, and the entire particles. That is, the amount of the nonmagnetic metal in the core portions can be subjected to separation measurement. By the TEM-EDX, an electron beam is selectively emitted onto a core portion or a shell layer, and the constituent element ratio of each portion can be quantitated. By the XPS, the bonding state between the respective elements forming a core portion or a shell layer can be examined.

The solid-solved state of the component belonging to the second group with respect to the component belonging to the first group contained in a core-shell particle can be determined from a lattice constant measured by XRD (X-ray Diffraction). For example, where Al or carbon is solid-solved in Fe, the lattice constant of the Fe varies with the amount of the solid solution. In the case of bcc-Fe having nothing solid-solved therein, the lattice constant is ideally approximately 2.86. However, if Al is solid-solved in bcc-Fe, the lattice constant becomes greater. If approximately 5 atomic % of Al is solid-solved, the lattice constant increases by approximately 0.005 to 0.01. Where approximately 10 atomic % of Al is solid-solved, the lattice constant increases by approximately 0.01 to 0.02. Where carbon is solid-solved in bcc-Fe, the lattice constant becomes larger. Where approximately 0.02 mass % of carbon is solid-solved, the lattice constant increases by approximately 0.001. In this manner, by carrying out XRD measurement on a core portion, the lattice constant of the magnetic metal is determined. Accordingly, based on the lattice constant, a check can be readily made to determine whether solid-solving has occurred, and how much is solid-solved. Alternatively, a check may be made to determine whether solid-solving has occurred, based on the diffraction pattern of particles measured by TEM.

The core portions may be polycrystalline or single-crystalline. However, the core portions are preferably single-crystalline. When a composite component containing core-shell particles including single-crystalline core portions is used in a high-frequency device, the magnetization easy axes can be aligned, and accordingly, magnetic anisotropy can be controlled. Thus, the high-frequency properties can be made higher than those of a high-frequency magnetic material containing core-shell particles including polycrystalline core portions.

The amount of the second-group element contained in the core portions is preferably 0.001 mass % or more but not more than 20 mass % with respect to the amount of the first-group element. If the contained amount of the second-group element exceeds 20 mass %, the saturation magnetization of the core-shell particles might be degraded. The contained amount of the second-group element is preferably 1 mass % or more but not more than 10 mass %, so as to achieve high saturation magnetization and solid solubility.

The mean particle size in the particle size distribution of the core portions 10 is not smaller than 1 nm and not larger than 1000 nm, or preferably, not smaller than 1 nm and not larger than 100 nm, or more preferably, not smaller than 10 nm and not larger than 50 nm. If the mean particle size of the core portions 10 is smaller than 10 nm, superparamagnetism might be generated, and the flux content of the obtained composite component might decrease. On the other hand, if the mean particle size exceeds 1000 nm, the eddy-current loss becomes larger in high-frequency regions of the obtained composite component, and the magnetic characteristics might be degraded in a target high-frequency region. If the particle size of the core portion is large in a core-shell particle, a multi-domain structure is more stable as a magnetic structure than a single-domain structure in terms of energy. At this point, in a core-shell particle having a multi-domain structure, the magnetic permeability of the obtained composite component has poorer high-frequency properties than those in a core-shell particle having a single-domain structure.

Therefore, in a case where core-shell particles are used as a high-frequency magnetic component, it is preferable to use core-shell particles each having a single-domain structure. Since the limit particle size of each core portion having a single-domain structure is approximately 50 nm or smaller, the mean particle size of the core portions is preferably 50 nm or smaller. In view of the above, the mean particle size of the core portions is not smaller than 1 nm and not larger than 1000 nm, or preferably, not smaller than 1 nm and not larger than 100 nm, or more preferably, not smaller than 10 nm and not larger than 50 nm.

(Shell Layers)

The above shell layers 20 coat at least part of the core portions, and include at least the oxide layers 21, as described above. The shell layers 20 may further include the carbon-containing material layers 22.

The forms of the oxide layer and the carbon-containing material layer in each of the shell layers are not particularly limited, but the oxide layer is preferably in close contact with core portion. Also, the ratio of the second-group metal element to the first-group magnetic metal is preferably higher in the oxide layer than in the core portion. This is because the oxidation resistance of the particle becomes higher at such a ratio.

(Shell Layer/Oxide Layer)

The above-described oxide layers 21 contain at least one element among the second-group elements constituting the core portions. That is, the core portions and the oxide layers have a common second-group element. In the oxide layers, the element that is the same as an element in the core portions forms an oxide. The above oxide layers are preferably layers formed by oxidizing the second-group element in the core portions.

The thickness of each of the oxide layers is preferably in the range of 0.01 to 5 nm. If the thickness of each of the oxide layers is above that range, the composition ratio of the magnetic metal becomes lower, and the saturation magnetization of the particles might be degraded. If the thickness of each of the oxide layers is below that range, stabilization of the oxidation resistance cannot be expected from the oxide layers.

The amount of oxygen in the oxide layers is not particularly limited. However, where the amount of oxygen in the core-shell particles is measured, the amount of oxygen is not less than 0.5 mass % and not more than 10 mass % with respect to the amount of the entire particles (whole mass amount of the particles), or preferably, not less than 1 mass % and not more than 10 mass %, or more preferably, not less than 2 mass % and not more than 7 mass %. If the amount of oxygen is above that range, the composition ratio of the magnetic metal becomes lower, and the saturation magnetization of the particles might be degraded. If the amount of oxygen is below that range, stabilization of the oxidation resistance cannot be expected from the oxide layers.

The amount of oxygen is quantitated in the following manner. Where a carbon-containing material layer coats each magnetic particle metal surface, for example, a measurement sample that weighs 2 to 3 mg in a carbon container in an inert atmosphere such as a He gas is heated to approximately 2000 degrees centigrade by high-frequency heating with the use of a Sn capsule as a combustion improver. In the oxygen measurement, the amount of oxygen can be calculated by detecting carbon dioxide generated as a result of a reaction between the oxygen in the sample and the carbon container due to the high-temperature heating. Where the magnetic particles are coated with an organic compound having its main chain made of hydrocarbon, temperature control is performed, and the combustion atmosphere is changed. In this manner, only the amount of oxygen deriving from the oxide layers is separately quantitated. Where the amount of oxygen in the core-shell particles is 0.5 mass % or less, the proportion of the oxide layer in each shell layer is smaller, and therefore, the heat resistance and the thermal reliability are poorer. Where the amount of oxygen in the core-shell particles is 10 mass % or more, the detachability of the oxide layers is higher.

(Shell Layer/Carbon-Containing Material Layer)

As the carbon-containing material layer 22 forming part of each of the shell layers 20, it is possible to use a hydrocarbon gas reaction product, a metal carbide, an organic compound, or the like. By virtue of the existence of this layer, oxidation of the metal material in the core portions can be effectively restrained, and the oxidation resistance becomes higher.

The mean thickness of the carbon-containing material layers is not less than 0.1 nm and not more than 10 nm, or more preferably, not less than 1 nm and not more than 5 nm. Here, a "thickness" is the length along the straight line extending from the center of a core-shell particle to the outer rim of the core-shell particle. If the thickness of each of the carbon-containing material layers is made smaller than 1 nm, the oxidation resistance becomes insufficient. Furthermore, the resistance of the composite component becomes extremely lower, and eddy-current loss is readily generated. As a result, the high-frequency properties of the magnetic permeability might be degraded.

If the thickness of each of the carbon-containing material layers exceeds 10 nm, the filling rate of the core portions in the component becomes lower by the amount equivalent to the thickness of each of the shell layers when the desired component is produced by integrating the core-shell particles coated with the carbon-containing material layers. As a result, the saturation magnetization of the obtained composite component might be degraded, and the magnetic permeability might become lower.

The thickness of each of the carbon-containing material layers can be determined through TEM observations.

The above hydrocarbon gas reaction product is a material that is generated by decomposing a hydrocarbon gas, and is used as the coating on the particle surfaces of the core portions. The above hydrocarbon gas may be an acetylene gas, a propane gas, or a methane gas, for example. The reaction product is thought to contain a carbon thin film, though not certain. Such a carbon-containing material layer preferably has reasonable crystallinity.

The crystallinity of a carbon-containing material layer is evaluated by assessing the crystallinity of the carbon-containing material layer at the vaporization temperature of hydrocarbon, to be specific. With the use of a device such as a TG-MS (thermogravimetric-mass spectroscopy) device, generation of hydrocarbon (the mass number being 16, for example) is monitored through an analysis in a hydrogen gas flow under atmospheric pressure, and an assessment is made based on the temperature at which the generation of hydrocarbon is maximized. The above mentioned vaporization temperature of hydrocarbon preferably falls within the range of 300 to 650 degrees centigrade, and more preferably, falls within the range of 450 to 550 degrees centigrade. This is because, if the vaporization temperature of hydrocarbon is equal to or higher than 650 degrees centigrade, the carbon-containing material layers are too dense, and hinder formation of oxide layers. If the vaporization temperature is equal to or lower than 300 degrees centigrade, the carbon-containing material layers have too many defects, and facilitate excess oxidation.

The above carbon-containing material layers may be made of a metal carbide material. The carbide in this case may be a carbide belonging to the first or second element group forming the core portions. Especially, silicon carbide and iron carbide are preferable, being stable and having appropriate thermal reliability.

The above carbon-containing material layers may be made of an organic compound. The organic compound layers may be formed on the surfaces of the above-described hydrocarbon gas reaction product. An organic compound preferably has a main chain formed with an organic polymer or oligomer containing carbon, hydrogen, oxygen, or nitrogen.

The above organic compound material is solid at ordinary temperatures and pressures. The organic compound can be selected from organic polymers or oligomers, whether it is a natural compound or a synthetic compound. The polymers or oligomers of this embodiment can be obtained by known radial polymerization or polycondensation.

The above organic compound can be selected from homopolymers or copolymers of polyorefins, polyvinyls, poly(vinyl alcohol)s, polyesters, poly(lactic acid)s, poly(glycolic acid)s, polystyrenes, poly(methyl(meth)acrylate)s, polyamides, polyurethanes, polycelluloses, and epoxy compounds. The organic compound can also be selected from polysaccharides made of natural polymers such as gelatin, pectin, or carrageenan.

Each shell layer made of such an organic compound preferably has a thickness of 2 nm or greater.

The oxygen permeability coefficient of the above organic compound is preferably $1\times10^{-17}$ [$cm^3$ (STP)·cm/$cm^2$·s·Pa] or more at ordinary temperatures and pressures. If the oxygen permeability coefficient of the above organic compound is equal to or lower than the above value, formation of oxide layers does not progress in the course of formation of an oxide-carbon-metal particulate aggregate or formation of core-shell particles, and property degradation might be caused. Therefore, an organic compound having an oxygen permeability coefficient lower than the above value is not preferable.

An oxygen permeability coefficient can be measured by a known technique, such as gas chromatography of a differential-pressure type compliant with JIS K7126-1 (differential-pressure method). That is, a film of an organic compound is prepared, and measurement is carried out by pressurizing one side and depressurizing the other permeation side. An assessment can be made in this manner. At this point, the permeating gas is separated by gas chromatography, and the amount of permeating gas per hour is measured by a thermal conductivity detector (TCD) and a flame ionization detector (FID). In this manner, the oxygen permeability coefficient can be calculated.

In this embodiment, the oxide layers and the carbon-containing material layers in the shell layers prior to the formation of a metal-containing particle composite component have the following functions.

If each of the shell layers includes only a carbon-containing material layer, oxidation in the core portion rapidly progresses due to cracks and the like in the carbon-containing material layer, and heat generation is locally caused. Chain-reaction oxidation involving the surrounding particles then progresses, resulting in aggregation and grain growth of core-shell particles.

If each of the shell layers includes only an oxide layer, unevenness is caused in part of the oxide composition. Therefore, there is a probability that there exists more portions in which oxide layers do not contain an oxide of a second-group metal element but mainly contain first-group elements. Oxides of second-group elements restrain element diffusion, and exhibit high protective characteristics for the core portions. On the other hand, oxides of first-group elements cause larger element diffusion than that by oxides of second-group elements, and are poorer in protective characteristics for the core portions. Therefore, if the oxide layers contain a large amount of an oxide of a first-group element, excess oxidation progresses in the core portions, and the function of the oxide layers as a magnetic material becomes weaker in a case where the magnetic material is formed as a metal-containing particle composite component.

Where each of the shell layers appropriately includes an oxide layer and a carbon-containing material layer, high oxidation resistance of the core-shell particles can be maintained. Furthermore, as a shell layer exists on the surface of each core-shell particle, the core-shell particles are in contact with one another via the shall layers. Accordingly, the probability that the metals of the core portions form interfaces directly with one another becomes lower. Thus, aggregation and grain growth accompanying metal element diffusion do not easily occur. Also, the magnetic material can reduce detachability of the oxide layers 21, and excels in heat resistance. In a case where the magnetic material is formed as a metal-containing particle composite component, the magnetic material further excels in thermal stability of the magnetic characteristics over a long period of time.

The ratio between the oxide layers and the carbon-containing material layers, or more preferably, the mass ratio between the oxide layer and the carbon-containing material layers, should fall within the range of 1:20 to 1:1.

(Method of Manufacturing the Core-Shell Magnetic Particles)

A method of manufacturing core-shell magnetic particles of this embodiment is now described. The method of manufacturing core-shell particles having a carbon coating removed therefrom includes the following steps:

(1) The step of forming metal-containing particles by placing metal elements in a plasma, the metal elements being at least one magnetic metal element selected from the first group including Fe, Co, and Ni, and at least one metal element selected from the second group including Mg, Al, Si, Ca, Zr, Ti, Hf, Zn, Mn, rare-earth elements, Ba, and Sr (the alloy particle forming step).

(2) The step of coating the surfaces of the above metal-containing particles with a carbon-containing material layer (the carbon coating step).

(3) The step of oxidizing the metal-containing alloy particles coated with the carbon in an oxygen-containing atmosphere (the oxidation step).

(4) The step of removing the carbon coating formed in the carbon coating step (2), which is carried out where necessary (the decarbonizing step).

In the following, the respective steps (1) through (4) are described.

((1) Alloy Particle Forming Step)

Alloy particles to be core portions are preferably manufactured by utilizing a thermal plasma technique or the like. The following is a description of a method of manufacturing the core portions by utilizing a thermal plasma technique.

First, a gas containing argon (Ar) as the main component is introduced as a plasma generating gas into a high-frequency induction thermal plasma device, to generate plasma. Magnetic metal powder (a metal belonging to the first group) and powder of a metal belonging to the second group are then sprayed into the plasma.

The step of forming the core portions is not limited to the thermal plasma technique. However, where the thermal plasma technique is utilized, nano-level material structures can be readily controlled, and large-scale synthesis can be performed. Therefore, the thermal plasma technique is preferable.

It should be noted that the metal powder to be sprayed into an argon gas can be magnetic metal powder that has a first-group magnetic metal and a second-group metal solid-solved therein, and has a mean particle size that is not smaller than 1 μm and not larger than 10 μm. The solid-solved powder having a mean particle size that is not smaller than 1 μm and not larger than 10 μm is synthesized by an atomizing technique or the like. By using solid-solved powder, core portions having uniform compositions can be synthesized by the thermal plasma technique.

It should be noted that core portions having nitrogen solid-solved therein are also preferable, having high magnetic anisotropy. To have nitrogen solid-solved in the core portions, nitrogen may be introduced as a plasma generating gas together with argon. However, the present disclosure is not limited to that.

((2) Carbon Coating Step)

Next, the step of covering the core portions with a carbon-containing material layer is described.

In this step, the following methods may be used: (a) a method to cause a hydrocarbon gas reaction on the surface of each core portion; (b) a method to form a carbide on the surface of each core portion by causing a reaction between carbon and a metal element contained in the core portions; and (c) a method to coat the surfaces of the core portions with an organic compound having a main chain made of hydrocarbon.

According to the hydrocarbon gas reacting method, which is the first method (a), a carrier gas as well as a hydrocarbon gas is introduced into the material surface of each of the core portions, to cause a reaction. The surface of each of the core portions is coated with the reaction product. The hydrocarbon gas used herein is not particularly limited, but may be an acetylene gas, a propane gas, or a methane gas, for example.

Alloys containing Fe, Co, or Ni as a main component are known as catalysts for decomposing a hydrocarbon gas and precipitating carbon. Through this reaction, excellent carbon-containing material layers can be formed. That is, alloy particles containing Fe, Co, or Ni as a main component are brought into contact with a hydrocarbon gas at a temperature within such an appropriate temperature range as to exhibit a catalyst action. In this manner, carbon layers that prevent the core portions from being in contact with one another are obtained.

The temperature of reaction between the alloy particles containing Fe, Co, or Ni as a main component and the hydrocarbon gas varies with hydrocarbon gas species, but a preferred reaction temperature is normally not lower than 200 degrees centigrade and not higher than 1000 degrees centigrade. If the reaction temperature is lower than that, the carbon precipitation amount becomes too small to form coatings. If the temperature of reaction is higher than that, the potential of carbon becomes too high, and excess precipitation occurs.

The temperature of reaction between the metal forming the shell layers and the hydrocarbon gas affects the stability of the carbon-containing material layers, or the crystallinity. A carbon-containing material layer formed at a high reaction temperature turns into a hydrocarbon gas at a high temperature, and a carbon-containing material layer formed at a low reaction temperature turns into a hydrocarbon gas at a low temperature.

In this manner, the stability of the carbon-containing material layers can be evaluated through a heating experiment in a hydrogen atmosphere. By using a device compliant with the TG-MS technique or the like, the vaporization temperature of hydrocarbon can be evaluated by measuring the temperature at which the gas concentration is maximized. For example, the temperature at which the amount of generation of a hydrocarbon gas with a mass number 16 is maximized may be set as the peak thermal decomposition temperature. As the peak temperature becomes higher, the stability of the carbon-containing material layers becomes higher. As the peak temperature becomes lower, the stability of the carbon-containing material layers becomes lower.

Also, a raw material containing carbon and the raw material to form the shell layers may be sprayed at the same time. The raw material containing carbon used according to this method may be pure carbon or the like, but the present disclosure is not limited to that.

The second method (b) is preferable, as the core portions can be coated with uniform carbon layers. However, the step of coating the core portion surfaces with carbon layers is not limited to the above-described two methods.

The metal element in the core portion surfaces can be carbonized by a known technique. For example, the metal element in the core portion surfaces may react with an acetylene gas or a methane gas by CVD. According to this method, thermally-stable carbon-containing material coating layers such as silicon carbide layers or iron carbide layers can be formed.

Various known methods can be used as the method (c) to form an organic compound coating. For example, there have been known a physicochemical nanoencapsulation method and a chemical nanoencapsulation method. The physicochemical method can be selected from known physicochemical methods for nanoencapsulation, such as phase separation or coacervation. The chemical method can be selected from known chemical methods for nanoencapsulation, such as interfacial polycondensation, interfacial polymerization, polymerization in a dispersion medium, in-situ polycondensation, and emulsion polymerization. The organic-compound shell layers are bound to the core portions or the oxide layers through physical binding, without covalent binding.

By the above-described method, magnetic metal cores (formed with metal particles stabilized by protective colloids), and core-shells coated with a polymer coating thicker than 2 nm can be obtained.

Also, by a method other than the above-described methods, shells made of an organic compound can be formed by injecting magnetic metal nanoparticles into a polymer solution to be the shells, and homogenizing the nanoparticles. For industrial applications, this method is easy and preferred.

By this method, particles do not need to exist independently of one another, and may exist as an aggregate that has an organic compound layer of a desired thickness formed between the core particles made of a magnetic metal.

((3) Oxidation Step)

The step of oxidizing the core portions coated with the carbon layers obtained in the above-described step is now described. In this step, the core portions are oxidized in the presence of oxygen. The oxide layers may be formed with the interfaces between the core portions and the carbon-containing material layers, or the carbon-containing material layers may be partially oxidized and decomposed to form the oxide layers.

Through this process, the core portions are oxidized. However, the second-group metal contained in the core portions should preferably be oxidized. That is, at least one nonmagnetic metal selected from the group including Mg, Al, Si, Ca, Zr, Ti, Hf, Zn, Mn, rare-earth elements, Ba, and Sr is oxidized to form an oxide layer on the surface of each of the core portions.

The oxidizing atmosphere is not particularly limited, and may be an oxidizing atmosphere such as the air, oxygen, or $CO_2$, a moisture-containing gas, or the like. Where oxygen is used, oxidation might rapidly progress if the oxygen concentration is high, and the particles might aggregate due to excess heat generation. Therefore, it is preferable to use a gas containing 5% or less of oxygen in an inert gas such as an Ar gas or a $N_2$ gas. More preferably, the gas contains 0.001% to 3% of oxygen. However, the present disclosure is not particularly limited to those amounts.

The oxidation in the above-described atmosphere may be performed in a heating environment. The temperature in that case is not particularly limited, but is preferably in the range of room temperature to about 300 degrees centigrade. This is because oxidation does not easily progress at temperatures lower than that, and oxidation rapidly progresses while the particles aggregate at temperatures higher than that.

The atmosphere gas and temperature used in the above-described oxidation step are preferably selected in accordance with the balance between the crystallinity or the stability of the carbon-containing material layers and the film thickness of each of the carbon-containing material layers. Where carbon-containing material layers with high stability are used, oxidation is preferably performed in a high oxygen potential state. Where carbon-containing material layers with low stability are used, oxidation is preferably performed in a low oxygen potential state.

Where thick carbon-containing material layers are used, oxidation is preferably performed in a high oxygen potential state. Where thin carbon-containing material layers are used, oxidation is preferably performed in a low oxygen potential state. Where oxidation is performed in a short period of time, the oxygen gas concentration may be about 10%. By the above-described manufacturing method, core-shell particles each having a shell layer formed with a carbon-containing material layer and an oxide layer can be manufactured.

((4) Decarbonizing Step)

If the core-shell particles obtained through the above-described steps are heated at several hundreds of degrees centigrade in a hydrogen atmosphere, for example, the carbon-containing material layers of the core-shell particles are removed. As a result, core-shell particles each having at least part of the surface of the core portion coated with an oxide layer are obtained. Through this step, the filling rate of the particles at the time of formation of a metal-containing particle composite component can be increased. Where the above-described organic compound such as an organic polymer or oligomer is removed, thermal decomposition is conducted in the presence of oxygen or hydrogen, and the organic compound is then decomposed and removed.

The atmosphere in which the heat treatment is performed is not particularly specified, but a reducing atmosphere that turns carbon into a hydrocarbon gas or an oxidizing atmosphere that turns carbon into a carbon oxide gas may be used.

The oxide layers made of a second-group element are normally stable at a temperature as high as about 1000 degrees centigrade in a reducing or oxidizing atmosphere, and are not easily decomposed or gasified. On the other hand, carbon or carbide layers can be turned into a hydrocarbon gas and be gasified when heated to several hundreds of degrees centigrade in a hydrogen atmosphere. Likewise, carbon or carbide layers can also be turned into a carbon oxide gas and be gasified when heated to several hundreds of degrees centigrade in an oxidizing atmosphere. Therefore, by suitably selecting a heating atmosphere, the oxide layers are left on, and only the carbon-containing material layers can be selectively removed.

The reducing atmosphere may be a nitrogen or argon atmosphere containing a reducing gas such as hydrogen or methane, for example. More preferably, the reducing atmosphere is a hydrogen gas atmosphere having a concentration of 50% or higher. This is because the carbon-containing material layers can be more efficiently removed in such a reducing atmosphere.

The oxidizing atmosphere may be a gas containing oxygen atoms, such as an oxygen gas, a carbon dioxide gas, or water vapor, or a mixed gas of a gas containing oxygen atoms, a nitrogen gas, and an argon gas.

The nitrogen or argon atmosphere containing a reducing gas is preferably an air flow, and the flow rate of the air flow is preferably 10 mL/min or higher.

The heating temperature in the reducing atmosphere is not particularly specified, and is preferably 100 to 800 degrees centigrade. More preferably, the heating temperature is 300 to 800 degrees centigrade. If the heating temperature is lower than 100 degrees centigrade, a reduction reaction might progress at a lower speed. If the heating temperature exceeds 800 degrees centigrade, aggregation and grain growth of the precipitated metal fine particles might progress in a short period of time.

More preferably, the heating temperature is selected, based on the crystallinity of the carbon-containing material layers, or the stability of the carbon-containing material layers. That is, where the carbon-containing material layers have high stability, the heating temperature should be relatively high. Where the carbon-containing material layers have low stability, the heating temperature should be relatively low.

The heat treatment temperature and time are not particularly limited, as long as they are suited at least for reducing the carbon-containing material layers.

The carbon content in the core-shell particles after the carbon removing process with a reducing gas is preferably 1 mass % or less. With this carbon content, the electrical influence can be lowered.

In the carbon removing operation in an oxidizing atmosphere, the following gas can be used: the air, a mixed gas such as an oxygen-argon gas or an oxygen-nitrogen gas, moisturized argon or moisturized nitrogen having a controlled dew point, or the like.

The carbon removal in an oxidizing atmosphere is preferably performed at the lowest possible oxygen partial pressure. By a method other than the above method, the carbon-containing material layers can be removed by using a mixed gas containing hydrogen and oxygen atoms. In such a case, the carbon removal and the oxidation can progress at the same time. Accordingly, more stable oxide layers can be formed.

The mixed gas may be a mixed gas of hydrogen and argon-oxygen, or a hydrogen gas having a controlled dew point, or the like, though not particularly limited.

The core-shell particles obtained in the above manner also have surfaces covered with oxide films, and aggregation does not easily occur.

Prior to the decarbonizing step, the oxygen permeability of the carbon-containing material layers are controlled by exposing the core-shell particles to plasma or an energy beam in an oxygen-containing atmosphere or an inert atmosphere, and damaging the crystallinity of the carbon-containing material layers. In this manner, oxide layers with an appropriate thickness can be formed under the carbon-containing material layers. The energy beam is preferably an electron beam, an ion beam, or the like. The oxygen partial pressure in an oxygen-containing atmosphere that can be used is preferably not lower than 10 Pa and not higher than $10^3$ Pa. If the oxygen partial pressure is above that range, plasma, an electron beam, or an ion beam is not easily excited or generated. If the oxygen partial pressure is below that range, the advantageous effect of the plasma or energy beam exposure cannot be expected.

(Binding Layer (Binder))

The core-shell particles manufactured according to the above-described embodiment are mixed and molded with the binder (the binding layer) 30 made of a resin or an inorganic material, and are used as the radiowave absorber 100 in a required form such as a sheet-like form, as illustrated in FIG. 1.

The radiowave absorber 100 is in the form of a bulk form (such as a pellet, a ring, or a rectangle), a film-like form such as a sheet, or the like, depending on the intended use.

In the core-shell particles and the radiowave absorber according to this embodiment, the material structures can be determined or analyzed by SEM or TEM, the diffraction patterns (including solid-solution checks) can be determined or analyzed by TEM diffraction or XRD, constituent element identification and quantitative analysis can be carried out by ICP emission spectrometry, fluorescent X-ray analysis, EPMA (Electron Probe Micro-Analysis), EDX, SIMS, TG-MS, oxygen/carbon analysis by an infrared absorption method, or the like.

In a case where a resin is used as the binder (the binding layer), the resin is a polyester resin, a polyethylene resin, a polystyrene resin, a polyvinyl chloride resin, a polyvinyl butyral resin, a polyurethane resin, a cellulose resin, an ABS resin, a nitrile-butadiene rubber, a styrene-butadiene rubber, an epoxy resin, a phenol resin, an amide resin, an imide resin, or a copolymer of those resins, though not particularly limited.

Instead of a resin, an inorganic material such as an oxide, a nitride, or a carbide may be used as the binder. Specifically, the inorganic material may be an oxide containing at least one metal selected from the group including Mg, Al, Si, Ca, Zr, Ti, Hf, Zn, Mn, rare-earth elements, Ba, and Sr, AlN, $Si_3N_4$, SiC, or the like.

Although not particularly limited, the magnetic sheet can be manufactured by mixing the core-shell particles with a resin and a solvent, and applying and drying the resultant slurry, for example. Also, the mixture of the core-shell particles and a resin may be pressed and molded into a sheet or a pellet. Further, the core-shell particles may be dispersed in the solvent, and may be deposited by electrophoresis or the like.

The magnetic sheet may have a stack structure. Being a stack structure, the magnetic sheet can easily have a greater thickness. Also, magnetic layers and nonmagnetic insulating layers are alternately stacked, so that the high-frequency magnetic characteristics can be improved. That is, each magnetic layer containing the core-shell particles is formed into a sheet with a thickness of 100 μm or smaller, and the sheet-like magnetic layers and nonmagnetic insulating oxide layers with a thickness of 100 μm or smaller are alternately stacked. With this stack structure, the high-frequency magnetic characteristics are improved. As the thickness of each single magnetic layer is 100 μm or smaller, the influence of a demagnetizing field can be made smaller when a high-frequency magnetic field is applied in an in-plane direction. Accordingly, not only the magnetic permeability can be made higher, but also the high-frequency properties of the magnetic permeability are improved. Although the stacking method is not particularly limited, layers can be stacked by pressure-bonding, heating, or sintering stacked magnetic sheets by a pressing technique or the like.

EXAMPLES

The following is a detailed description of examples that will be compared with comparative examples.

Example 1

Argon is introduced as a plasma generating gas at 40 L/min into a chamber of a high-frequency induction thermal plasma device, to generate plasma. A Fe powder having a mean particle size of 10 μm, a Co powder having a mean particle size of 10 μm, and an Al powder having a mean particle size of 3 μm are sprayed as raw materials at 3 L/min, together with argon (a carrier gas), into the plasma in the chamber, so that Fe:Co:Al becomes 69:31:5 in mass ratio to the total amount.

At the same time, a methane gas as a raw material of the carbon coating is introduced together with an Ar carrier gas into the chamber, and the gas temperature and the powder temperature are controlled. In this manner, magnetic metal particles having FeCoAl alloy particles coated with carbon are obtained.

The carbon-coated magnetic metal particles are oxidized for about 5 minutes, and an aggregate of core-shell particles each coated with a carbon-containing material layer and an oxide layer is obtained.

By TEM, the carbon-containing material layers and the oxide layers are observed on the surfaces of the FeCoAl cores. The mean particle size of the core-shell particles is 19.1 nm, and the amount of oxygen is 3.4 mass %. The oxygen analysis is carried out with a gas analysis device (TC-600, manufactured by LECO Corporation) in the following manner. A measurement sample that weighs 2 to 3 mg in a carbon container is heated to approximately 2000 degrees centigrade in a He gas atmosphere by high-frequency heating with a Sn capsule as a combustion improver. In the oxygen measurement, the amount of oxygen is calculated by detecting carbon dioxide generated as a result of a reaction caused between the oxygen in the sample and the carbon container by the high-temperature heating.

The thermal stability of the carbon-containing material layers of this sample is examined by using TG-MS. A hydrogen gas of 99% or higher in purity is introduced at a flow rate of 200 mL/min under atmospheric pressure, and the temperature is raised at 20 degrees centigrade/min. As a result, the peak of the mass number 16 originating from a hydrocarbon gas is detected, and the peak (the vaporization temperature of hydrocarbon) appears in the neighborhood of 499 degrees centigrade.

The core-shell particles and a resin are mixed at a mass ratio of 100:30, and are formed into a thick film to serve as an evaluation sample. The volume filling rate of the core-shell particles was 30.8%. The volume filling rate of the magnetic components was 18.7%.

Example 2

The core-shell particles of Example 1 and a resin are mixed at a mass ratio of 100:20, and are formed into a thick film to serve as an evaluation sample. The volume filling rate of the core-shell particles was 38.3%. The volume filling rate of the magnetic components was 25.1%.

Example 3

The core-shell particles of Example 1 and a resin are mixed at a mass ratio of 100:40, and are formed into a thick film to serve as an evaluation sample. The volume filling rate of the core-shell particles was 24.6%. The volume filling rate of the magnetic components was 16.3%.

Example 4

The core-shell particles of Example 1 and a resin are mixed at a mass ratio of 100:50, and are formed into a thick film to serve as an evaluation sample. The volume filling rate of the core-shell particles was 20.1%. The volume filling rate of the magnetic components was 14.0%.

Example 5

The core-shell particles of Example 1 and a resin are mixed at a mass ratio of 100:70, and are formed into a thick film to serve as an evaluation sample. The volume filling rate of the core-shell particles was 14.7%. The volume filling rate of the magnetic components was 9.8%.

Example 6

The core-shell particles of Example 1 and a resin are mixed at a mass ratio of 100:15, and are formed into a thick film to serve as an evaluation sample. The volume filling rate of the core-shell particles was 45.8%. The volume filling rate of the magnetic components was 30.1%.

Example 7

Argon is introduced as a plasma generating gas at 40 L/min into a chamber of a high-frequency induction thermal plasma device, to generate plasma. A Fe powder having a mean particle size of 10 μm, a Co powder having a mean particle size of 10 μm, and an Al powder having a mean particle size of 3 μm are sprayed as raw materials at 3 L/min, together with argon (a carrier gas), into the plasma in the chamber, so that Fe:Co:Al becomes 69:31:10 in mass ratio to the total amount.

At the same time, a methane gas as a raw material of the carbon coating is introduced together with an Ar carrier gas into the chamber, and the gas temperature and the powder temperature are controlled. In this manner, magnetic metal particles having FeCoAl alloy particles coated with carbon are obtained.

The carbon-coated magnetic metal particles are oxidized for about 5 minutes, and an aggregate of core-shell particles each coated with a carbon-containing material layer and an oxide layer is obtained.

By TEM, the carbon-containing material layers and the oxide layers are observed on the surfaces of the FeCoAl cores. Between the particles, there exist oxide particles made of alumina that is formed with the shells detached from the core-shell particles. By virtue of the oxide particles, the insulation properties between the particles, or the insulation properties of the sample, are further improved. The mean particle size of the core-shell particles is 24.5 nm, and the amount of oxygen is 3.7 mass %.

The thermal stability of the carbon-containing material layers of this sample is examined by using TG-MS. A hydrogen gas of 99% or higher in purity is introduced at a flow rate of 200 mL/min under atmospheric pressure, and the temperature is raised at 20 degrees centigrade/min. As a result, the peak of the mass number 16 originating from a hydrocarbon gas is detected, and the peak (the vaporization temperature of hydrocarbon) appears in the neighborhood of 650 degrees centigrade.

The core-shell particles and a resin are mixed at amass ratio of 100:20, and are formed into a thick film to serve as an evaluation sample. The volume filling rate of the core-shell particles was 37.1%. The volume filling rate of the magnetic components was 18.7%.

Example 8

The core-shell particles of Example 1 are grown as particles through a high-temperature heat treatment at 600 degrees centigrade. The particles of 34.9 nm in mean particle size and a resin are then mixed at a mass ratio of 100:30, and are formed into a thick film to serve as an evaluation sample. The volume filling rate of the core-shell particles was 31.4%. The volume filling rate of the magnetic components was 21.0%.

Comparative Example 1

The core-shell particles of Example 1 and a resin are mixed at a mass ratio of 100:10, and are formed into a thick film to serve as an evaluation sample. The volume filling rate of the core-shell particles was 56.1%. The volume filling rate of the magnetic components was 35.2%.

Comparative Example 2

The core-shell particles of Example 1 and a resin are mixed at a mass ratio of 100:80, and are formed into a thick film to serve as an evaluation sample. The volume filling rate of the core-shell particles was 9.8%. The volume filling rate of the magnetic components was 6.8%.

Comparative Example 3

The core-shell particles of Example 1 and a resin are mixed at a mass ratio of 100:5, and are formed into a thick film to serve as an evaluation sample. The volume filling rate of the core-shell particles was 58.0%. The volume filling rate of the magnetic components was 38.0%.

Each of radiowave absorbers containing the core-shell particles obtained in Examples and Comparative Examples is loaded to a coaxial tube test fixture (CSH2-APC7, manufactured by Kanto Electronic Application and Development Inc.), and the relative permittivity ∈' and the magnetic loss coefficient tan δm(μ"/μ') are calculated from the reflection coefficient $S_{11}$ and the permeation coefficient $S_{21}$ of the S parameters. Each of the samples had a ring-like shape with an inside diameter of 3.04 mm or smaller, an outside diameter of 7.00 mm or smaller, and a thickness of 2 mm or smaller. Thin metal plates that are 1 mm in thickness and have the same areas are bonded to the electromagnetic wave receiving surfaces and the opposite surfaces of the samples, and measurement is carried out in free space by a reflected power method using a sample network analyzer $S_{11}$ mode with electromagnetic waves in the X- or Ku-band. The reflected power method is a method of measuring by how many decibels the level of reflection from a sample has decreased, compared with the level of reflection from a thin metal plate not bonded to any sample (a complete reflector). Based on the measurement, each amount of electromagnetic wave absorption was defined by an amount of decrease in reflection. Where the amount of absorption in Comparative Example 1 was 1, each amount of absorption less than 1 was evaluated as "poor", each amount of absorption larger than 1 but smaller than 1.5 was evaluated as "good", and each amount of absorption of 1.5 or larger was evaluated as "very good". The electrical resistance was calculated by forming Au electrodes of 5 mm in diameter by performing sputtering on the front and back surfaces of a disk-like sample of 15 mm in diameter and 1 mm in thickness, and reading the value of the current generated when a voltage of 10 V was applied between the electrodes. Since the values of the current have time dependence, each measured value is the value that was measured two minutes after the voltage application. Table 1 shows the results.

TABLE 1

| | Structure of radio wave absorber | | | Characteristics of radio wave absorber | | | | | |
|---|---|---|---|---|---|---|---|---|---|
| | | | | | | Magnetic loss coefficient (tanδm) | | | |
| | Particle size of core-shell particles (nm) | Volume filling rate of core-shell particles (%) | Volume filling rate of magnetic components (%) | Electrical resistance (MΩ · cm) | Permittivity (ε') | 8 GHz | 12 GHz | 18 GHz | Radio wave absorption characteristics |
| Example 1 | 19.1 | 30.8 | 18.7 | >1000 | 9.5 | 0.6 | 0.9 | 0.8 | Very good |
| Example 2 | 19.1 | 38.3 | 25.1 | >100 | 11 | 0.7 | 1.1 | 0.9 | Very good |

TABLE 1-continued

| | Structure of radio wave absorber | | | Characteristics of radio wave absorber | | | | | |
|---|---|---|---|---|---|---|---|---|---|
| | Particle size of core-shell particles (nm) | Volume filling rate of core-shell particles (%) | Volume filling rate of magnetic components (%) | Electrical resistance (MΩ · cm) | Permittivity (ε') | Magnetic loss coefficient (tanδm) 8 GHz | 12 GHz | 18 GHz | Radio wave absorption characteristics |
| Example 3 | 19.1 | 24.6 | 16.3 | >1000 | 8.1 | 0.5 | 0.7 | 0.5 | Very good |
| Example 4 | 19.1 | 20.1 | 14.0 | >1000 | 6.7 | 0.4 | 0.6 | 0.4 | Very good |
| Example 5 | 19.1 | 14.7 | 9.8 | >1000 | 5.1 | 0.3 | 0.5 | 0.3 | Very good |
| Example 6 | 19.1 | 45.8 | 30.1 | 20 | 15 | 0.9 | 1.5 | 1.0 | Good |
| Example 7 | 24.5 | 37.1 | 18.7 | >1000 | 7.9 | 0.8 | 1.0 | 0.6 | Very good |
| Example 8 | 34.9 | 31.4 | 21.0 | 80 | 13 | 0.6 | 0.9 | 0.9 | Good |
| Comparative Example 1 | 19.1 | 56.1 | 35.2 | 0.2 | 30 | 1.1 | 1.8 | 1.2 | Standard |
| Comparative Example 2 | 19.1 | 9.8 | 6.8 | >1000 | 4.5 | 0.1 | 0.3 | 0.1 | Poor |
| Comparative Example 3 | 19.1 | 58.0 | 38.0 | 0.001 | 100 | 1.3 | 2.0 | 1.4 | Poor |

It has become apparent from Table 1 that radiowave absorbers having good characteristics are obtained where the volume filling rate of the core-shell particles is not lower than 10% and not higher than 55%. It also has become apparent that radiowave absorbers having even better characteristics are obtained where the volume filling rate is not lower than 15% and not higher than 40%.

Figure 3:
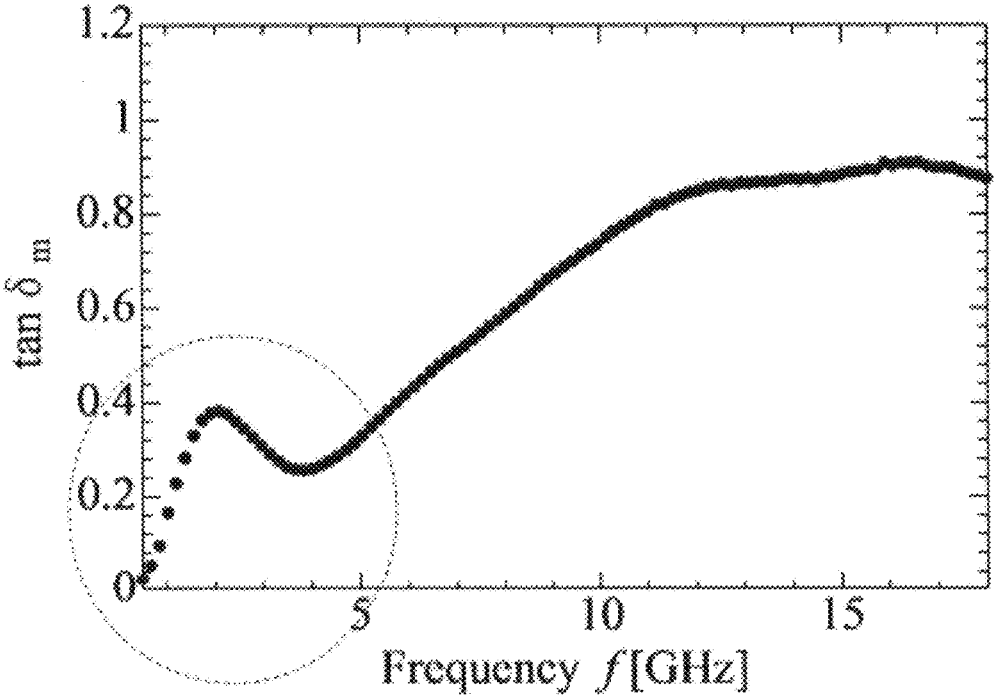
FIG. 3 is a graph showing magnetic loss coefficients (tan δm) of a radiowave absorber of Example 8.

FIG. 3 is a graph showing the magnetic loss coefficient (tan δm) of the radiowave absorber of Example 8. As indicated by the dotted line in the graph, a peak appears in the low-frequency region. The particle size of the core-shell particles is preferably 25 nm or larger. If the particle size is 25 nm or larger, the band in which the core-shell particles are usable as a radiowave absorber can be widened.

While certain embodiments and examples have been described, these embodiments and examples have been presented byway of example only, and are not intended to limit the scope of the inventions. Indeed, a radiowave absorber described herein may be embodied in a variety of other forms; furthermore, various omissions, substitutions and changes in the form of the devices and methods described herein may be made without departing from the spirit of the inventions. The accompanying claims and their equivalents are intended to cover such forms or modifications as would fall within the scope and spirit of the inventions.

What is claimed is:

1. A radiowave absorber comprising:

a plurality of core-shell particles each comprising:

a core portion comprising at least one magnetic metal element selected from a first group consisting of Fe, Co, and Ni, and at least one metal element selected from a second group consisting of Mg, Al, Si, Zr, Ti, Hf, Zn, Mn, rare-earth elements, Ba, and Sr; and a shell layer coating at least part of the core portion, the shell layer comprising a carbon-containing material layer and an oxide layer comprising at least one metal element that is selected from the second group and which is comprised in the core portion, a mass ratio between the oxide layer and the carbon-containing material layer being 1:20 to 1:1; and a binding layer binding the core-shell particles, the binding layer having a higher resistance than the core-shell particles, wherein a volume filling rate of the core-shell particles in the radiowave absorber is not lower than 10% and not higher than 55% and wherein a volume filling rate of magnetic components in the radiowave absorber is 9.8-30.1%.

2. The radiowave absorber according to claim 1, wherein said radiowave absorber has an electrical resistance of 10 MΩ·cm or higher.

3. The radiowave absorber according to claim 1, wherein oxygen contained in the oxide layer is not less than 0.5 mass % and not more than 10 mass %, with respect to the amount of the entire particle.

4. The radiowave absorber according to claim 1, wherein the carbon-containing material layer is a decomposition product of a hydrocarbon gas.

5. The radiowave absorber according to claim 1, wherein a vaporization temperature of hydrocarbon in the carbon-containing material layer is not lower than 300 degrees centigrade and not higher than 650 degrees centigrade when the carbon-containing material layer is heated in a hydrogen atmosphere.

6. The radiowave absorber according to claim 1, wherein the carbon-containing material layer is an organic compound.

7. The radiowave absorber according to claim 6, wherein the organic compound is an organic polymer or oligomer with a main chain containing one of carbon, hydrogen, oxygen, and nitrogen.

8. The radiowave absorber according to claim 6, wherein an oxygen permeability coefficient of the carbon-containing material layer made of the organic compound is equal to or higher than 1×10-17[cm3(STP)·cm/cm2·s·Pa].

9. The radiowave absorber according to claim 1, further comprising an oxide particle comprising at least one element that is comprised in the core portion and belongs to the second group, wherein the ratio of the number of atoms of the element belonging to the second group to the number of atoms of an element belonging to the first group in the oxide particle is higher than the ratio of the number of atoms of the element belonging to the second group to the number of atoms of an element belonging to the first group in the oxide layer.

* * * * *